US007193150B2

(12) United States Patent
Bello

(10) Patent No.: US 7,193,150 B2
(45) Date of Patent: Mar. 20, 2007

(54) SUBMERSIBLE PUMP CABLE WITH AIR LINE

(76) Inventor: Paul Bello, 525 21st NE., Salem, OR (US) 97301

( * ) Notice: Subject to any disclaimer, the term of this patent is extended or adjusted under 35 U.S.C. 154(b) by 0 days.

(21) Appl. No.: 10/925,665

(22) Filed: Aug. 24, 2004

(65) Prior Publication Data

US 2006/0042817 A1 Mar. 2, 2006

(51) Int. Cl.
*H01B 7/34* (2006.01)

(52) U.S. Cl. ..... 174/36

(58) Field of Classification Search ..... 174/36, 174/110 R, 113 R, 117 R, 117 F, 117 FF
See application file for complete search history.

(56) References Cited

U.S. PATENT DOCUMENTS

| | | | | |
|---|---|---|---|---|
| 3,603,718 | A * | 9/1971 | Gedenk | 174/47 |
| 3,975,115 | A * | 8/1976 | Fisher et al. | 417/38 |
| 4,314,969 | A * | 2/1982 | Arthur et al. | 422/82.01 |
| 4,476,923 | A * | 10/1984 | Walling | 166/66.4 |
| 5,145,007 | A * | 9/1992 | Dinkins | 166/386 |
| 5,148,864 | A * | 9/1992 | Willis et al. | 166/65.1 |
| 5,384,430 | A * | 1/1995 | Anthony et al. | 174/115 |
| 5,553,666 | A * | 9/1996 | Hartman | 166/60 |
| 5,670,747 | A * | 9/1997 | Lawer et al. | 174/74 R |
| 6,127,632 | A * | 10/2000 | Oswald et al. | 174/120 R |
| 6,298,917 | B1 * | 10/2001 | Kobylinski et al. | 166/369 |
| 6,397,945 | B1 * | 6/2002 | Manke et al. | 166/65.1 |
| 6,531,658 | B2 * | 3/2003 | Tanaka et al. | 174/117 F |
| 2003/0205402 | A1 * | 11/2003 | Koyasu et al. | 174/113 C |
| 2005/0087360 | A1 * | 4/2005 | Speer | 174/113 C |

FOREIGN PATENT DOCUMENTS

| | | | |
|---|---|---|---|
| GB | 2 275 127 A | * | 8/1994 |
| JP | 09-270209 A | * | 10/1997 |

OTHER PUBLICATIONS

Kalas Manufacturing Incorporated (Ground Water Division) Denver, PA. (2002). *Submersible Pump Cable.* [Brochure].

* cited by examiner

*Primary Examiner*—William H. Mayo, III
(74) *Attorney, Agent, or Firm*—Marger Johnson & McCollom P.C.

(57) ABSTRACT

A submersible pump cable includes a conductive wire and an air line. The air line is structured to determine the depth at which the submersible pump cable lies beneath a liquid.

8 Claims, 1 Drawing Sheet

SUBMERSIBLE PUMP CABLE WITH AIR LINE

BACKGROUND OF THE INVENTION

1. Technical Field of the Invention

This disclosure relates in general to submersible cables for pump applications, and more particularly, to improved submersible cables that incorporate an air line.

2. Description of the Related Art

Submersible pump cable is well-known in the art. As the name implies, submersible pump cable is used to supply current to submersible pumps. Submersible pump cable is used within the well casing, and a typical operating environment with temperatures between −40° and 75° C., in circuits not exceeding 600 V. One type of submersible pump cable, known as the twisted type, consists of four copper conductors, either solid or stranded, that are insulated with a PolyVinyl Chloride (PVC) sheath. The conductors and their PVC sheaths have a circular cross-section. One of the conductors is typically used as a ground connection. The four conductors, with their associated sheaths, are twisted around each other to form the submersible pump cable.

Another type of submersible pump cable used for heavy duty applications is the flat jacketed type. For this type of cable, each of the conductors and their PVC sheaths are laid out side-by-side, that is, parallel to each other. A flat PVC jacket is disposed around the outside of the circular PVC sheaths. The flat PVC jacket provides an additional measure of abrasion resistance.

Because the water table varies throughout the year, it is oftentimes desirable to know how much water is available to pump. For example, a submersible pump may be at the bottom of a well that is 300 feet deep. During a wet winter, the water table may be, for example, 50 feet below the ground surface. In other words, the pump is submerged under 250 feet of water. During a dry summer, however, the water table may drop, for example, by 50 feet. Consequently, the pump is now submerged under 200 feet of water.

Based upon the amount of water that is available, a pump may be adjusted to operate at a selected pumping rate. For example, one particular pump may be adjusted to pump between 5 gallons/minute to 100 gallons/minute. Other pumps may have different pumping rates. The fastest pumping rate might be used when the submerged depth of the pump is at a maximum and the slowest pumping rate might be used when the submerged depth of the pump is at a minimum.

A conventional way of determining how deep the pump is submerged below the surface of the water is by using an air line. The air line is nothing more than a hollow tube. One end of the air line is attached to the pump when it is submerged, but the end of the air line remains open to allow liquid and gas to pass through the end of the air line. The other end of the air line may be coupled to a pressure gauge and an air pump. The air pump is configured to occasionally pump air through the air line until all the liquid is expelled from the air line. The pressure gauge records the air pressure required to clear the liquid from the air line.

It is well known that 1 pound per square inch (p.s.i.) of pressure will raise a column of water by 2.31 feet. Conversely, a column of water 1 foot tall exerts a pressure of 0.434 p.s.i. Using these figures and the air pressure that was recorded by the pressure gauge, a calculation of the depth that the pump is submerged may be obtained. For example, if the pressure gauge records a pressure of 27.0 p.s.i., the pump lies submerged at a depth of 63.0 feet [(27.0 p.s.i.)×(2.31 feet/p.s.i.)=62.99 feet].

Currently, conventional air lines and conventional submersible pump cables are manufactured separately. Embodiments of the invention address this and other disadvantages of the conventional art.

DETAILED DESCRIPTION OF THE INVENTION

Embodiments of the invention provide a combined submersible pump cable and air line. Consequently, the air line benefits from being protected by one or more of the conductors, PVC sheathing, and/or PVC jacket of the submersible pump cable. By incorporating the pump cable and air line into one combined cable, embodiments of the invention provide additional convenience and increased protection to the air line compared to the conventional art.

In the following detailed description, numerous exemplary embodiments of the invention will be described with reference to the attached FIGURES. Although the specification below may refer to "an", "one", "another", or "some" embodiment(s) in several locations, this does not necessarily mean that each such reference is to the same embodiment(s), or that the feature described only applies to a single embodiment.

Figure 1:
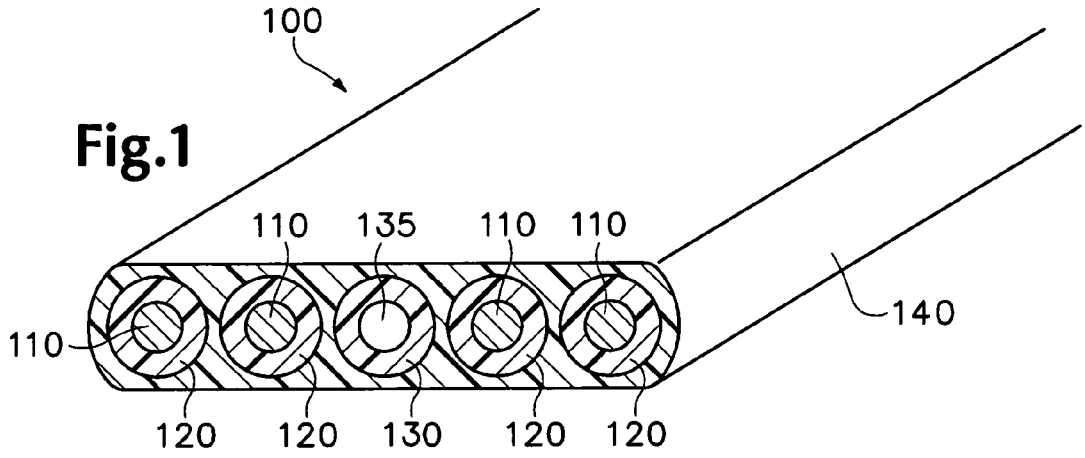
FIG. 1 is a perspective diagram illustrating a flat jacket submersible pump cable that is combined with an air line according to some embodiments of the invention.

FIG. 1 is a perspective diagram illustrating a flat jacket submersible pump cable that is combined with an air line according to some embodiments of the invention.

The submersible pump cable 100 includes four conductors 110 and one air line 130. The conductors 110 may be composed of a single large copper wire or many small strands of copper wire twisted together. In alternative embodiments other metals may be used to form the conductors 110.

The conductors 110 are surrounded by PVC sheaths 120 that have ring-shaped cross sections. As shown in FIG. 1, the air line 130 may itself be a PVC sheath that has a ring-shaped cross section. The air line 130 defines a circular void 135 that runs the length of the air line 130. The circular void 135 and the air line 130 together form the hollow tube that is used to measure the height of the water above the submersible pump.

The submersible pump cable 100 also includes a flattened PVC jacket 140 that is disposed around the PVC sheaths 120 and the air line 130. The PVC jacket 140 holds the PVC sheaths 120 and the air line 130 in a side by side, parallel configuration.

Although in these embodiments the air line 130 is positioned centrally among the conductors 110, alternative embodiments may have the air line 130 in a different position relative to the conductors 110 and PVC sheaths 120.

Consequently, according to the embodiments described above, a submersible pump cable 100 of the flat jacket type may also include an air line 130 within the PVC jacket 140, thus providing additional durability to the air line 130. Additionally, since the air line 130 is now part of the submersible pump cable 100, the additional connection to the submersible pump required by the conventional air line is conveniently eliminated.

Figure 2:
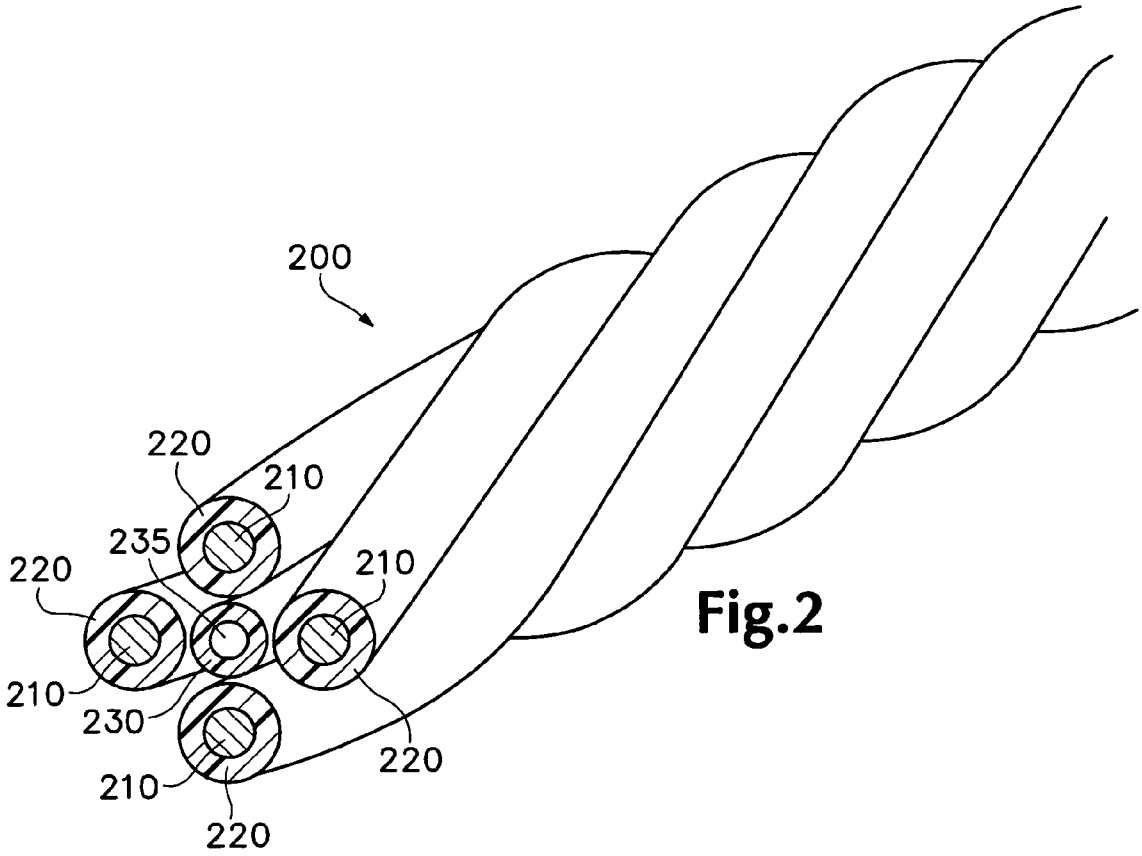
FIG. 2 is a perspective diagram illustrating a twisted submersible pump cable that is combined with an air line according to other embodiments of the invention.

FIG. 2 is a perspective diagram illustrating a twisted submersible pump cable that is combined with an air line according to other embodiments of the invention.

A submersible pump cable 200 includes four conductors 210 and one air line 230. The conductors 210 may be composed of a single large copper wire or many small strands of copper wire twisted together. In alternative embodiments other metals may be used to form the conductors 210.

The conductors 210 are surrounded by PVC sheaths 220 that have ring-shaped cross sections. The air line 230 may itself be a PVC sheath that has a ring-shaped cross section. The air line 230 defines a circular void 235 that runs the length of the air line 230. The circular void 235 and the air line 230 together form the hollow tube that is used to measure the height of the water above the submersible pump.

In the embodiments illustrated in FIG. 2, the conductors 210 and their protective PVC sheaths 220 are twisted around the air line 230, thereby protecting it from abrasion. This is the preferred embodiment. However, in alternative embodiments the air line 230 may be in a different position relative to the conductors 210 and PVC sheaths 220. That is, instead of being centrally located among the twisted conductors 210 and PVC sheaths 220, the air line 230 may itself be twisted together with the conductors 210 and sheaths 220.

Consequently, according to the embodiments described above, a submersible pump cable 200 of the twisted type may also include an air line 230 centrally located among the twisted conductors 110, thus providing additional durability to the air line 230. Additionally, since the air line 230 is now part of the submersible pump cable 200, the additional connection to the submersible pump that is required by the conventional air line is conveniently eliminated.

Having described several exemplary embodiments of the invention, it should be apparent that modifications and variations of the described embodiments that do not depart from the inventive concepts disclosed above will be obvious to those of skill in the art.

For example, the flat jacket type of submersible pump cable and the twisted type of submersible pump cable described above are just two examples of submersible pump cables. Other embodiments of the invention may include an air line together with another type of submersible pump cable.

As yet another example, embodiments of the invention may also include more than one air line in the submersible pump cable. This would provide a backup air line if one of them became damaged or clogged.

As another example, in the embodiments described above with respect to FIG. 1 the protective PVC sheaths for the conductors had approximately the same diameter as the air line. In alternative embodiments, such as the embodiments described in FIG. 2, the diameter of the PVC sheaths may be smaller or larger than the diameter of the air line.

As another example, the embodiments described above were assumed to be used in water pumping application. However, the embodiments described above may work equally well in applications where a liquid other than water is being pumped.

Finally, it should be apparent that even though the embodiments described above used copper conductors and PVC for the insulating material, alternative embodiments may use conductors of different metals and insulating material of different types.

Consequently, the scope of the invention should not be limited only to the embodiments described above, but to all embodiments as defined and encompassed by the attached claims.

I claim:

1. A submersible pump cable comprising:

a hollow air line, the hollow air line surrounding and defining a void that extends along a length of the hollow air line, the hollow air line having a radially outer surface;

a first conductive element having a length end a radially outer surface;

a first insulating sheath radially surrounding the first conductive element and contiguous with the radially outer surface of the first conductive element along the length of the first conductive element, the first insulating sheath having a length and a radially outer surface, and a jacket surrounding the hollow air line and the first insulating sheath, the radially outer surface of the hollow air line having a cross-section in a direction perpendicular to the length of the hollow air line that forms a closed loop, the radially outer surface of the first insulating sheath having a cross-section in a direction perpendicular to the length of the first conductive element that forms a closed loop, the jacket contiguous with the radially outer surface of the hollow air line along the cross-section of the hollow air line, and the jacket contiguous with the radially outer surface of the first insulating sheath along the cross-section of the first insulating sheath.

2. The submersible pump cable of claim 1, the jacket substantially contiguous with the radially outer surface of the hollow air line over the length of the hollow air line, the jacket substantially contiguous with the radially outer surface of the first insulating sheath over the length of the first insulating sheath.

3. The submersible pump cable of claim 2, the jacket consisting of PVC.

4. The submersible pump cable of claim 3, further comprising another hollow air line, the another hallow air line surrounding and defining a void that extends along a length of the hollow air line, the hollow air line having a radially outer surface, the jacket surrounding the another hollow air line, the jacket in physical contact with the radially outer surface of the another hollow air line over the length of the another hollow air line.

5. The submersible pump cable or claim 3, the jacket structured to maintain the hollow air line and conductive element at a substantially constant distance from one another along a length of the jacket.

6. The submersible pump cable of claim 1, a cross-section of the jacket in a direction perpendicular to a length of the jacket having a shape that is flattened on two sides, the two sides opposite each other.

7. The submersible pump cable of claim 1, further comprising:

a second conductive element having a length and a radially outer surface; and a second insulating sheath disposed in physical contact with the radially outer surface of the second conductive element along the length of the second conductive element.

8. A cable comprising:

an electrical cable configured to supply current to an electrically powered device; and a hollow air line that is physically connected to the electrical cable along a length of the electrical cable, the hollow air line defining a void that runs along a length of the hollow air line;

the electrical cable comprising a flat-type submersible pump cable including:

conductive elements disposed lengthwise through the cable, the conductive elements having a length;

insulating sheaths, each insulating sheath surrounding one of the conductive elements, the insulating sheaths abutting an outer surface of the conductive elements over the length of the conductive elements; and a jacket surrounding the insulating sheaths and the hollow air line, the jacket abutting outer surfaces of the insulating sheaths over a length of the insulating sheaths, the jacket abutting an outer surface of the hollow air line over a length of the hollow air line.

* * * * *